United States Patent [19]

Bachmann

[11] 4,291,401

[45] Sep. 22, 1981

[54] DEVICE FOR SECURING A WATCH DIAL TO A WATCH-MOVEMENT PLATE

[75] Inventor: Peter Bachmann, Bettlach, Switzerland

[73] Assignee: Ebauches Bettlach S.A., Bettlach, Switzerland

[21] Appl. No.: 96,394

[22] Filed: Nov. 21, 1979

[30] Foreign Application Priority Data

Nov. 30, 1978 [CH] Switzerland ..... 12276/78

[51] Int. Cl.[3] ..... G04B 19/06

[52] U.S. Cl. ..... 368/236

[58] Field of Search ..... 58/127 R, 127 B, 104; 368/236

[56] References Cited

FOREIGN PATENT DOCUMENTS 2211689 7/1974 France ..... 58/127 B 38943 6/1907 Switzerland ..... 58/127 B 67933 12/1913 Switzerland ..... 58/127 B 289105 3/1951 Switzerland ..... 58/127 B

*Primary Examiner*—Vit W. Miska

*Attorney, Agent, or Firm*—Stevens, Davis, Miller & Mosher

[57] ABSTRACT

A cylindrical bearing segment of a preferably metal sleeve is positioned within a hole in a watch-movement plate. A portion of the sleeve intended to project inwardly beyond the plate is divided by a lengthwise slot into two claws which yield so that the sleeve can be inserted in the hole by simple axial pressure. When the dial is to be fitted in place, a dial-foot is inserted in the sleeve, pushing the claws apart by pressing against inner bulges at the ends of the claws, these bulges then pressing laterally against the dial-foot and locking it firmly in place.

4 Claims, 2 Drawing Figures

DEVICE FOR SECURING A WATCH DIAL TO A WATCH-MOVEMENT PLATE

This invention relates to a device for securing a watch dial to the plate of a watch movement, of the type comprising dial-feet integral with the dial, corresponding holes in the plate, and sleeves inserted in these holes and divided lengthwise into a securing portion sunk in the plate and a gripping portion projecting toward the interior of the movement and formed of claws separated by slots.

Numerous proposals have recently been r ade in an attempt to find a suitable means of securing dials to timepiece movements, and particularly to the movements of wrist watches. This involves taking into account such factors as mass-production requirements and the greatest possible degree of automation. Thus, in Swiss Pat. Nos. 503,303 and 536,508, the plate is provided with locking members of plastic material or rubber intended to press laterally against the dial-feet. These designs have the advantage of facilitating automation of the dial-fitting operation, which consists merely in moving the dial toward the plate parallel to the axis of the watch movement to insert the dial-feet in the holes. However, practical experience has shown that these designs present two drawbacks: for one thing, members made of relatively supple plastic material or of rubber may be subject to ageing; and for another thing, although fitting of the dial is an extremely simple operation, it remains a toilsome operation to fit the locking members on the plate.

Swiss Pat. Nos. 38,943, 67,933, and 289,105 describe locking members in the form of sleeves mounted in the plate. These sleeves are driven or screwed into holes in the plate and aligned with the dial-feet. In these prior art devices, therefore, the placing of the sleeves is an operation which forms part of the manufacture of the plate. In certain cases, the resilient portions of the sleeves, intended to grip the dial-feet, project from the inner side of the plate, whereas in other cases they project from the outer side or are sunk in widened portions of the holes in the plate. In every case, however, the sleeves must be machined in such a way as to be fitted exactly to the holes in the plate, and they are secured during the course of manufacturing this main component of the movement.

French Pat. No. 2,211,689 proposes a securing device in which the means for locking the dial-feet no longer form part of the plate. The latter is machined with holes which open out into widened seats situated on the reverse side of the plate, and the device includes an annular or disk-shaped intermediate part provided with tubes which, during fitting of the movement, enter holes in the plate and then receive the dial-feet. This arrangement simplifies manufacture of the plate and placing of the dial by making it possible to perform these operations mechanically. However, the intermediate part provided increases the thickness of the movement. Moreover, since this intermediate part must be made of a synthetic material, it is also subject to the drawbacks of ageing.

It is an object of this invention to provide a device for securing a dial to a movement plate which offers another solution, not exhibiting the drawbacks of the prior art systems, to the problem outlined above.

To this end, in the device according to the present invention, the securing portion of each sleeve includes a cylindrical bearing segment situated within one of the holes and two shoulders bounding this bearing segment and respectively engaging two opposite faces of the plate, and the slots extend from the projecting end of the sleeves to within the bearing segment.

A preferred embodiment of the invention will now be described in detail with reference to the accompanying drawing, in which.

Figure 1:
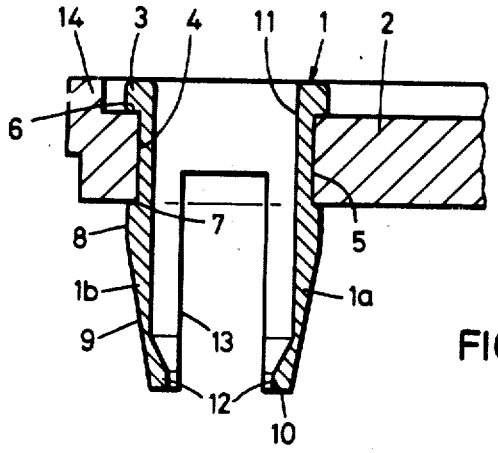
FIG. 1 is a sectional view of a locking sleeve mounted on a plate.

The securing device shown in the drawing represents a considerable simplification of all the necessary operations, not only of producing the locking member, but also of putting it in place and, finally, of fitting the dial. This locking member 1 (FIG. 1) is a metal part which may be produced by profile-turning. It has the general shape of a cylindrical sleeve and is intended to be secured by one of its ends to a plate 2 of a watch movement, the other end projecting from the reverse side of plate 2. At the end secured to plate 2, sleeve 1 comprises first of all an outer flange 3 bounding a cylindrical bearing segment 4, the diameter of which matches that of a hole 5 intended to receive it. Comprised between flange 3 and bearing segment 4 is a flat annular shoulder 6, while a flat outer shoulder 7 likewise bounds segment 4 at the other end thereof. Starting from shoulder 7, sleeve 1 projects toward the interior of the watch movement and comprises a cylindrical outer face 8 followed by a frustoconical face 9 ending in a plane shoulder 10, the outside diameter of shoulder 10 being less than the diameter of hole 5.

The inner face of sleeve 1, designated by reference numeral 11, is cylindrical and extends to the base of an annular inner bulge 12. Finally, a slot 13, extending from shoulder 10 to a point between shoulders 7 and 6, divides the projecting portion of sleeve 1 into two opposite symmetrical claws 1*a* and 1*b*.

To position sleeve 1 in hole 5, it suffices to insert it axially from the dial side, i.e., from above as viewed in FIG. 1. Since slot 13 extends to a point between the two ends of segment 4, the two parts of shoulder 7 separated by slot 13 are able to pass through hole 5 as claws 1*a* and 1*b* yield inwardly, and member 1 can assume the position shown in FIG. 1 simply by virtue of the axial force exerted upon it. It will be noted that this operation may take place after fitting of the movement and may thus be carried out at whatever juncture is most suitable in the series of finishing operations.

Plate 2 is machined with a peripheral rim 14 which passes outside hole 5 and is, in this embodiment, of the same height as flange 3. Hence flange 3 is sunk within the confines of rim 14.

It will be understood that in a watch movement equipped with the device described, plate 2 will have, for example, two holes 5 disposed near its periphery at two locations suitably chosen so that the projecting portions of sleeves 1 inserted in these holes do not interfere with the functional components of the movement. Sleeves 1 may be inserted in holes 5 once the movement has been fitted in place and just before fitting of the dial. This operation may easily be mechanized and be carried out automatically on a mass-production basis. After sleeves 1 have been put in place, the dial-fitting operation follows.

Figure 2:
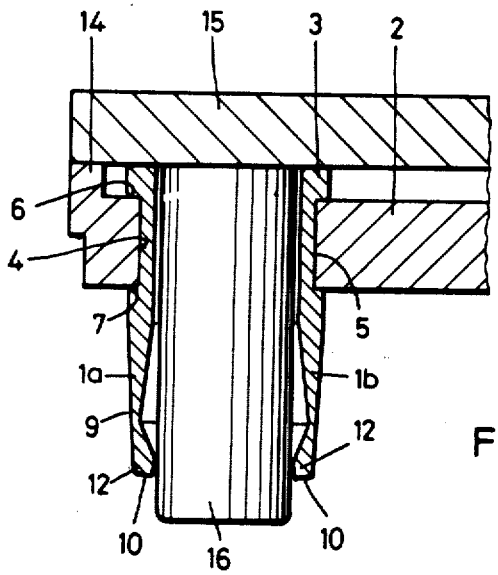
FIG. 2 is a sectional view of the same locking member with the dial and a dial-foot fitted in place.

FIG. 2 shows the device after securing of a dial 15, which is a metal plate having cylindrical dial-feet 16 fixed to the back of it, e.g., by soldering, in a well-known manner. Dial-feet 16 are slightly longer than sleeves 1. Dial 15 is fitted by moving it axially toward plate 2. The diameter of dial-feet 16 is slightly less than that of inner face 11 of sleeve 1 but greater than the inside diameter of annular bulge 12. Moreover, the two parts of bulge 12 separated by slot 13 may be kept inwardly displaced somewhat by slight biasing resulting from the pressure of bearing segment 4 against the inside of hole 5. When dial-foot 16 is inserted in sleeve 1, on the other hand, the two parts of bulge 12 are pushed outwardly by the resilient bending of claws 1*a* and 1*b*, so that they press strongly against the cylindrical outer surface of dial-foot 16. The axial movement of dial 15 is continued until its periphery rests against rim 14, the area surrounding dial-foot 16 then being in contact with the upper surface of flange 3. Because of the shape of sleeves 1, the deformation they undergo upon insertion of dial-foot 16 is a complex deformation which takes place with an expansion ensuring correct fitting of dial 15.

Each dial has a number of dial-feet corresponding to the number of holes 5 in the plate and associated sleeves 1, and these dial-feet are distributed around the periphery of the dial so as to match the sleeves and engage within the inner faces 11 thereof by a simple movement of the dial parallel to itself in the direction of the axis of the watch movement.

Sleeves 1 will preferably be metal parts, e.g., of nickel silver. However, they might obviously be made of plastic material instead, if need be.

What is claimed is:

1. A device for securing a watch dial having two or more integral dial-feet to a watch-movement plate including opposing substantially planar faces and a like number of holes for receiving said dial-feet, of the type having a sleeve inserted through each of said holes, each said sleeve including a first portion sunk in said plate and a second portion projecting from the face of said plate intended to be situated remote from said dial, said second portion being formed of a plurality of claws separated from one or more slots, wherein the improvement comprises:

said sleeves are made of substantially non-deformable metal, a cylindrical bearing segment included in each said first portion and situated within the associated one of said holes, two radially outwardly extending substantially non-deformable shoulders, preformed before insertion of the sleeve into the respective hole, bounding said bearing segment and each having a planar face which abuts a respective substantially planar face of said plate, the exterior of said second portion being frustoconical in shape, the diameter of the smaller base thereof, most remote from said plate, being less than the diameter of said holes, said one or more slots extending from the end of said second portion remote from said plate to within said bearing segment, and said one or more slots being of sufficient length and width to permit said claws to bend resiliently toward the interior of said sleeve, thereby allowing the one of said non-deformable shoulders nearest said second portion to enter the associated one of said holes during insertion of said sleeve.

2. The device of claim 1, wherein each said sleeve includes a single diametrical slot separating it longitudinally into two facing said claws.

3. The device of claim 2, wherein the ends of said claws remote from said bearing segment each include an inner bulge intended to press resiliently against the side of one of said dial-feet when said dial is secured to said plate.

4. The device of claim 1, wherein said plate includes at the periphery thereof a dial-support rim spaced from said holes, said first portion of each said sleeve including an annular flange extending to the same level as said rim.

* * * * *